US009976266B1

(12) United States Patent
Rosenbaugh et al.

(10) Patent No.: US 9,976,266 B1
(45) Date of Patent: May 22, 2018

(54) SYSTEM INCLUDING ADJUSTABLE CONTINUITY JOINTS AND/OR ROTATION MITIGATION SLIDING POSTS FOR RAIL ELEMENTS

(71) Applicant: The Board of Regents of the University of Nebraska, Lincoln, NE (US)

(72) Inventors: Scott K. Rosenbaugh, Lincoln, NE (US); Jennifer D. Schmidt, Eagle, NE (US); Robert Bielenberg, Lincoln, NE (US); Ronald K. Faller, Lincoln, NE (US); Karla A. Lechtenberg, Raymond, NE (US); John D. Reid, Lincoln, NE (US); James C. Holloway, Lincoln, NE (US)

(73) Assignee: NUTECH VENTURES, Lincoln, NE (US)

( * ) Notice: Subject to any disclaimer, the term of this patent is extended or adjusted under 35 U.S.C. 154(b) by 0 days. days.

(21) Appl. No.: 15/096,889

(22) Filed: Apr. 12, 2016

Related U.S. Application Data

(60) Provisional application No. 62/146,677, filed on Apr. 13, 2015.

(51) Int. Cl.
*E01F 15/00* (2006.01)
*E01F 15/08* (2006.01)
*E01F 15/04* (2006.01)

(52) U.S. Cl.
CPC ..... *E01F 15/088* (2013.01); *E01F 15/0407* (2013.01); *E01F 15/0446* (2013.01); *E01F 15/0453* (2013.01)

(58) Field of Classification Search
CPC ..... E01F 15/0446; E01F 15/0453; E01F 15/0407; E01F 15/088
(Continued)

(56) References Cited

U.S. PATENT DOCUMENTS 4,502,812 A * 3/1985 Zucker ..... E01F 15/025 256/13.1
5,074,704 A * 12/1991 McKay ..... E01F 15/006 256/13.1

(Continued)

OTHER PUBLICATIONS

Schmidt, Jennifer; Faller, Ronald; Sicking, Dean; Reid, John; Lechtenberg, Karla; Bielenberg, Robert; Rosenbaugh, Sott; Holloway, Jim; "Development of a New Energy-Absorbing Roadside/Median Barrier System with Restorable Elastomer Cartridges", The University of Nebraska Lincoln, Jul. 16, 2013.

(Continued)

*Primary Examiner* — Raymond W Addie

(57) ABSTRACT

A structural assembly may include a first prefabricated structural element having a first angled face at an end of the first prefabricated structural element; a second prefabricated structural element having a second angled face at an end of the second prefabricated structural element, the end of the second precast barrier segment connected to the end of the first prefabricated structural element; and a coupling assembly connecting the first angled face of the first prefabricated structural element to the second angled face of the second prefabricated structural element. The coupling assembly provides shear and moment continuity across the first and second prefabricated structural elements. This allows for a variable gap due to manufacturing tolerances, construction tolerances, and/or expansion or contraction.

20 Claims, 12 Drawing Sheets

(58) Field of Classification Search
USPC ..... 404/6, 9; 52/582.1, 282.1
See application file for complete search history.

(56) References Cited

U.S. PATENT DOCUMENTS 5,464,306 A * 11/1995 Cristiano ..... E01F 15/088 256/13.1
5,688,071 A * 11/1997 Owen ..... E01F 15/006 256/13.1
6,059,491 A * 5/2000 Striefel ..... E01F 15/086 256/13.1
6,203,242 B1 * 3/2001 Englund ..... E01F 15/083 256/13.1
6,413,009 B1 * 7/2002 Duckett ..... E01F 15/083 404/6
6,428,237 B1 * 8/2002 Duckett ..... E01F 15/086 256/13.1
6,485,224 B1 * 11/2002 Dyke ..... E01F 15/006 16/250
6,767,158 B1 * 7/2004 Consolazio ..... E01F 15/088 404/6
7,144,188 B1 * 12/2006 Mallinson ..... E01F 15/086 404/6
8,079,774 B2 12/2011 House et al.
2008/0118305 A1 * 5/2008 Carey ..... E01F 15/025 404/6
2009/0226252 A1 * 9/2009 Field ..... E01F 13/028 404/6
2009/0297263 A1 * 12/2009 Redlberger ..... E01F 15/083 404/6

OTHER PUBLICATIONS

Schmidt, Tyler; Faller, Ronald; Sicking, Dean; Reid, John; Lechtenberg, Karla; Bielenberg, Robert; Rosenbaugh, Sott; Holloway, Jim; "Evaluation of Energy Absorbers for Use in a Roadside/Median Barrier", The University of Nebraska Lincoln, Feb. 6, 2014.

* cited by examiner

SYSTEM INCLUDING ADJUSTABLE CONTINUITY JOINTS AND/OR ROTATION MITIGATION SLIDING POSTS FOR RAIL ELEMENTS

CROSS-REFERENCE TO RELATED APPLICATIONS

The present application claims the benefit under 35 U.S.C. § 119 (e) of U.S. Provisional Patent Application No. 62/146,677, filed Apr. 13, 2015, and titled "SYSTEM INCLUDING ADJUSTABLE CONTINUITY JOINTS AND/OR ROTATION MITIGATION SLIDING POSTS FOR RAIL ELEMENTS." U.S. Provisional Patent Application No. 62/146,677 is incorporated herein by reference in its entirety.

FEDERALLY SPONSORED RESEARCH OR DEVELOPMENT

This invention was made with U.S. Government support under Grant No. DPUSTWD(94) awarded by the Federal Highway Administration/Nebraska Department of Roads (FHWA/NDOR). The U.S. Government has certain rights in this invention.

BACKGROUND

Barrier systems (including a plurality of barrier segments made from concrete, metal, and/or plastic) are often installed along roads to separate traffic moving in a first direction from traffic moving in a second (e.g., opposite) direction. Barriers can also be used to block off roads, building entrances, work zones, ditches, cliffs, and so forth. Typically, the barrier segments are rectangular, triangular, trapezoidal, or similar prism- like concrete, steel, or plastic structures that can be lined up with one another to form a barrier system having a selected length. While such barriers generally work to prevent drivers from entering blocked off territories, they can fail in high speed and/or high impact situations.

SUMMARY

A structural assembly is disclosed herein. In embodiments, the structural assembly comprises: a first prefabricated structural element having a first angled face at an end of the first prefabricated structural element; a second prefabricated structural element having a second angled face at an end of the second prefabricated structural element, the end of the second precast barrier segment connected to the end of the first prefabricated structural element; and a coupling assembly connecting the first angled face of the first prefabricated structural element to the second angled face of the second prefabricated structural element. The coupling assembly provides shear and moment continuity across the first and second prefabricated structural elements. This allows for a variable gap due to manufacturing tolerances, construction tolerances, and/or expansion or contraction.

In embodiments, the structural assembly is implemented for a barrier system; however, it is noted that the structural assembly can be used to connect various structures in an end-to-end arrangement. For example, in addition to precast barrier segments, the prefabricated structural elements can comprise wall panels, deck panels, bridge girders, building beams, other barrier/wall elements, and so forth. In a barrier system implementation, the barrier system includes: a first precast barrier segment (e.g., concrete or other material block, beam, panel, or the like) having a first angled face at an end of the first precast barrier segment; a second precast barrier segment having a second angled face at an end of the second precast barrier segment, the end of the second precast barrier segment connected to the end of the first precast barrier segment; and a coupling assembly connecting the first angled face of the first precast barrier segment to the second angled face of the second precast barrier segment.

In some embodiments, elastically-deformable support structures (e.g., rubber block or the like) support the precast barrier segments on a support surface (e.g., the ground). Sliding posts (e.g., ski-like structures) can also be disposed between the precast barrier segments and the support surface, where the sliding posts can slide laterally upon the support surface and provide secondary support to prevent the precast barrier segments from overturning when any of the elastically-deformable support structures are deformed.

In some embodiments, the precast barrier segments need not necessary have angled facets. While a V-shaped coupling assembly is described above, the coupling assembly could alternately be a splice plate, a splice tube system, an X-connection system, or any other coupling assembly that connects an end of first precast barrier segment to an end of the second precast barrier segment, wherein the coupling assembly is in contact with internal and external portions of the first and second precast barrier segments.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. Any dimensions included in the accompanying figures are provided by way of example only and are not meant to limit the present disclosure.

DETAILED DESCRIPTION

Referring generally to FIGS. 1 through 12, energy-absorbing, restorable traffic barrier systems are described. Coupling assemblies for connecting adjacent prefabricated structural elements end-to-end are also described. In some embodiments, the coupling assembly is an adjustable continuity joint (ACJ) that allows prefabricated structural elements (e.g., rigid or semi-rigid segments) that can be made from various materials (e.g., concrete, plastic, or other composite material) to have continuity when assembled. For example, prefabricated structural elements have manufacturing tolerances that allow products to vary from nominal details. Using the systems and techniques described herein, manufacturing and installation tolerances can allow the widths of gaps between prefabricated segments to vary. Further, an ACJ can account for these tolerances while still providing continuity between adjacent segments.

As described herein, an ACJ can be used to connect adjacent structural elements together. In some embodiments, the structural elements can be beams, such as precast concrete beams/panels, wooden beams/panels, fiber-reinforced plastic (FRP) elements, steel elements, and so on. However, beams are provided by way of example and are not meant to limit the present disclosure. In other embodiments, an ACJ can be used to connect other structural elements together, including, but not necessarily limited to, panels, such as wall panels for a building, noise wall panels for a roadside system, other wall panels, deck panels, bridge girders, building beams, an any other barrier, wall, or supportive structures.

Figure 1:
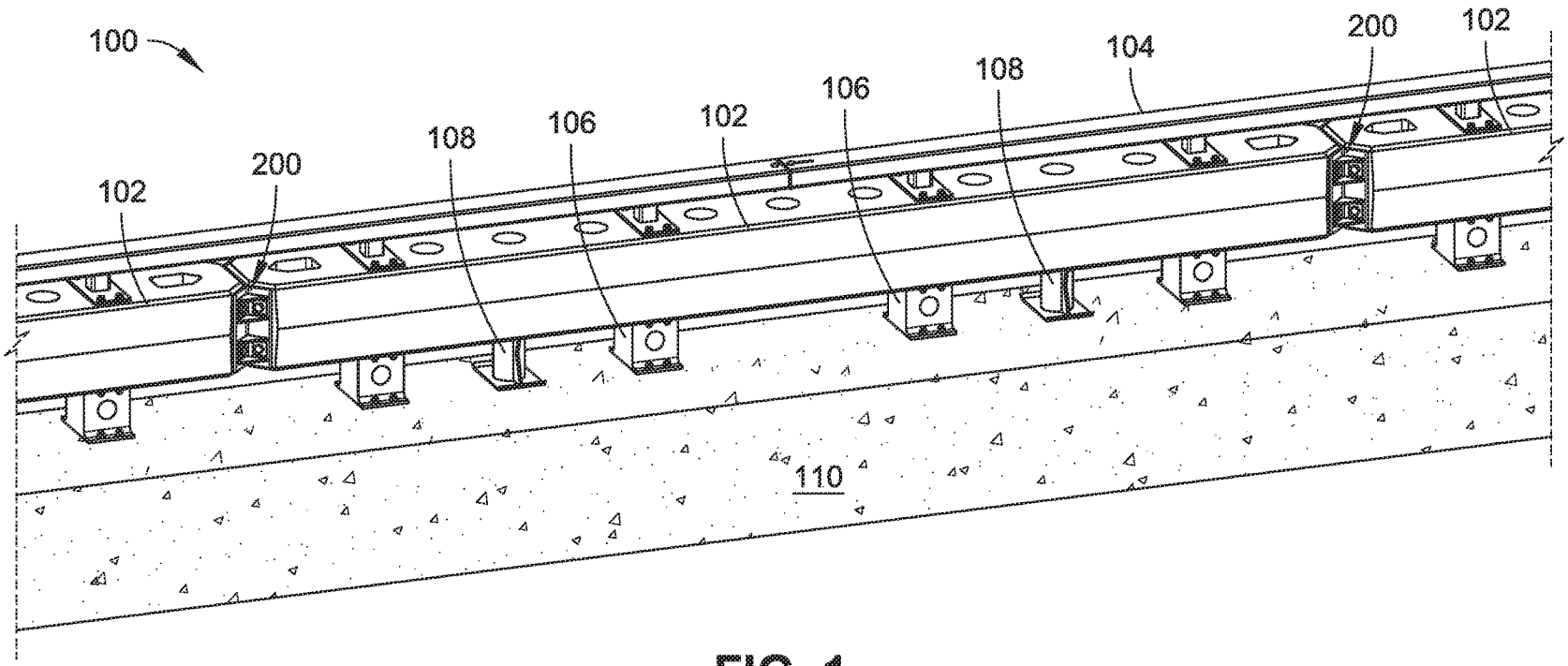
FIG. 1 is an isometric view of the barrier system implemented in accordance with an embodiment of this disclosure.
Figure 2:
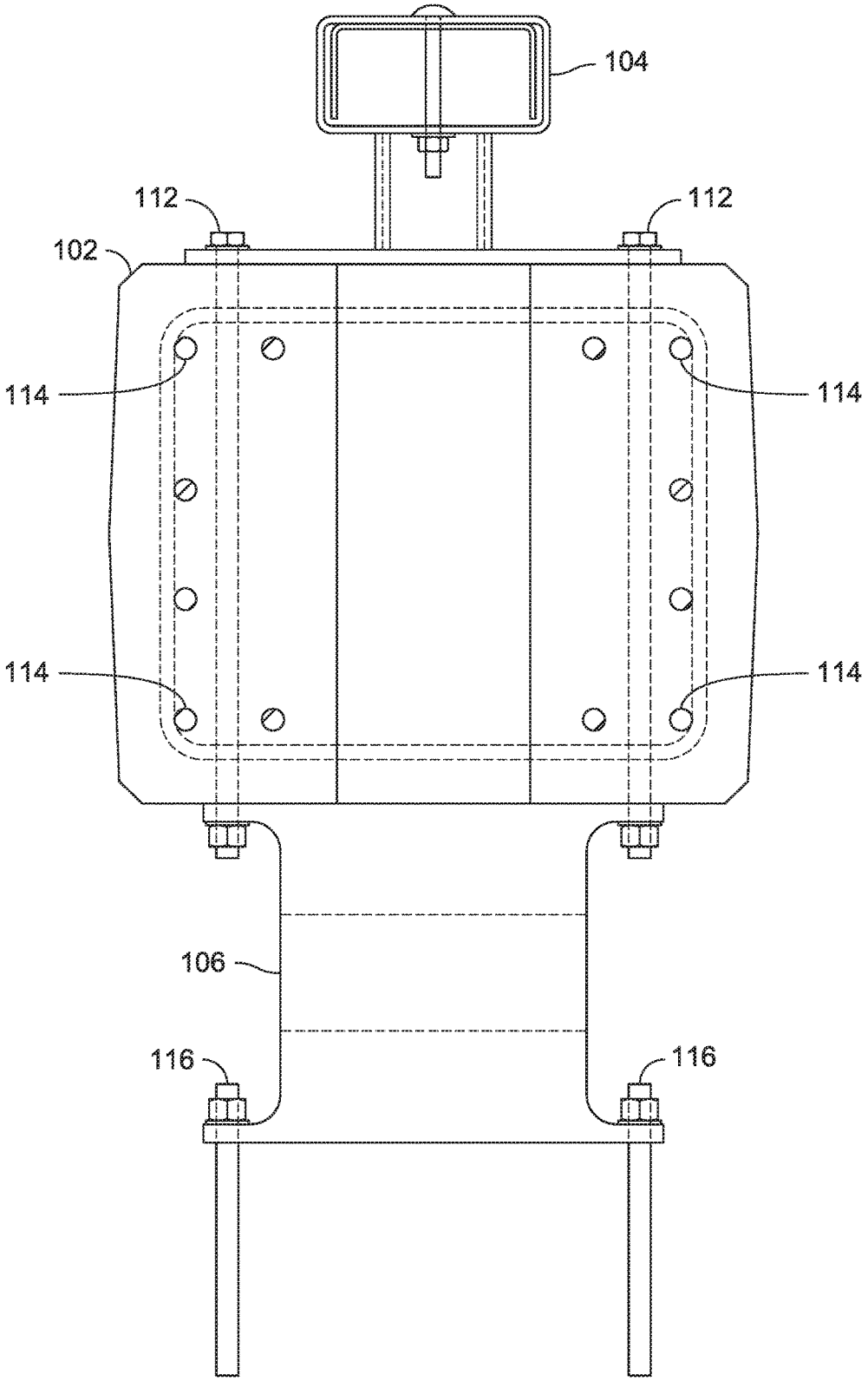
FIG. 2 is an end view of a barrier segment for a barrier system, in accordance with an embodiment of this disclosure.

FIG. 1 shows a coupling assembly 200 implemented for a barrier system 100, in accordance with an embodiment of this disclosure. As shown, the barrier system 100 can include two or more barrier segments 102, referring generally to the precast concrete, plastics, and/or metal segments of the system 100. The barrier segments 102 can be coupled together by coupling assemblies 200 (e.g., ACJs) that couple the barrier segments 102 end-to-end, as discussed in further detail below. A shown in FIG. 2, each barrier segment 102 can have at least one end with drilled holes 114 which may have screw anchors or nuts disposed therein or accessible therethrough for attaching to the coupling assembly 200. In some embodiments, the barrier segments 102 may also be coupled to a railing 104 that extends over the tops of some or all of the barrier segments 102. The railing 104 can also couple the barrier segments 102 together and may also be at a height that makes it more visible to driver, thus enabling them to maintain an adequate distance from the barrier segments 102. For example, FIG. 2 shows an end view of the railing 104 attached to the barrier segment 102 by fasteners 112. Fasteners can include, but are not limited to, bolts, threaded couplings, mechanical wedges/anchors, and the like.

Figure 3:
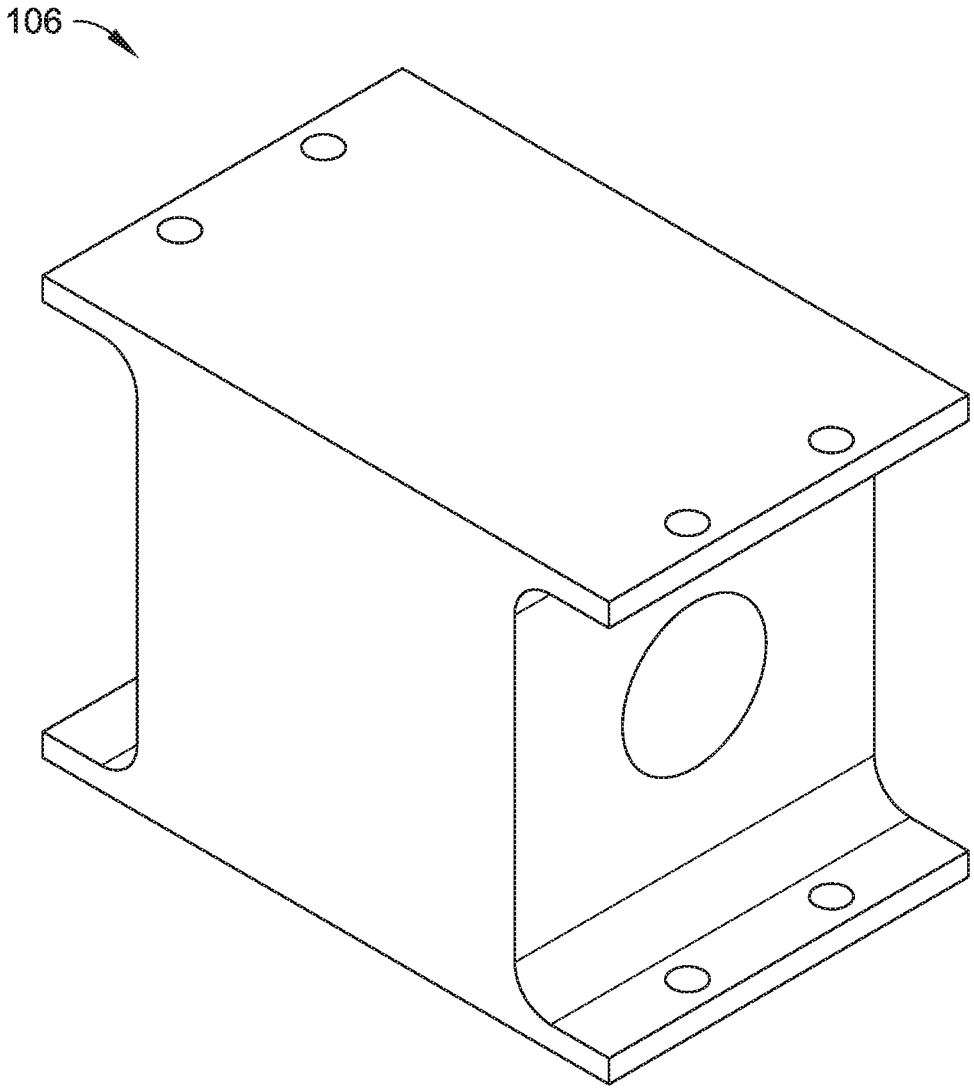
FIG. 3 is an isometric view of an elastically-deformable support for the barrier system, in accordance with an embodiment of this disclosure.
Figure 4:
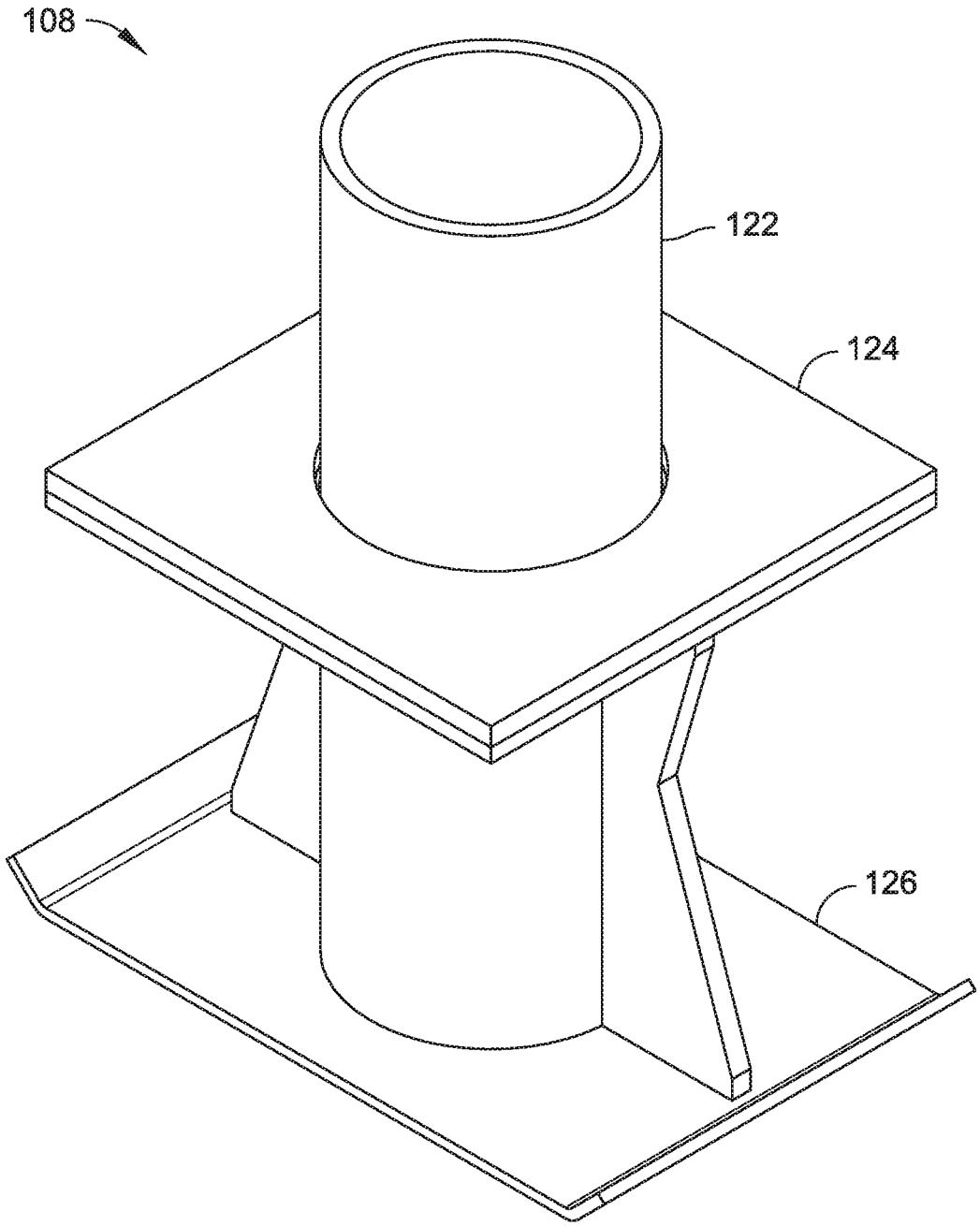
FIG. 4 is an isometric view of a ski assembly for the barrier system, in accordance with an embodiment of this disclosure.
Figure 5:
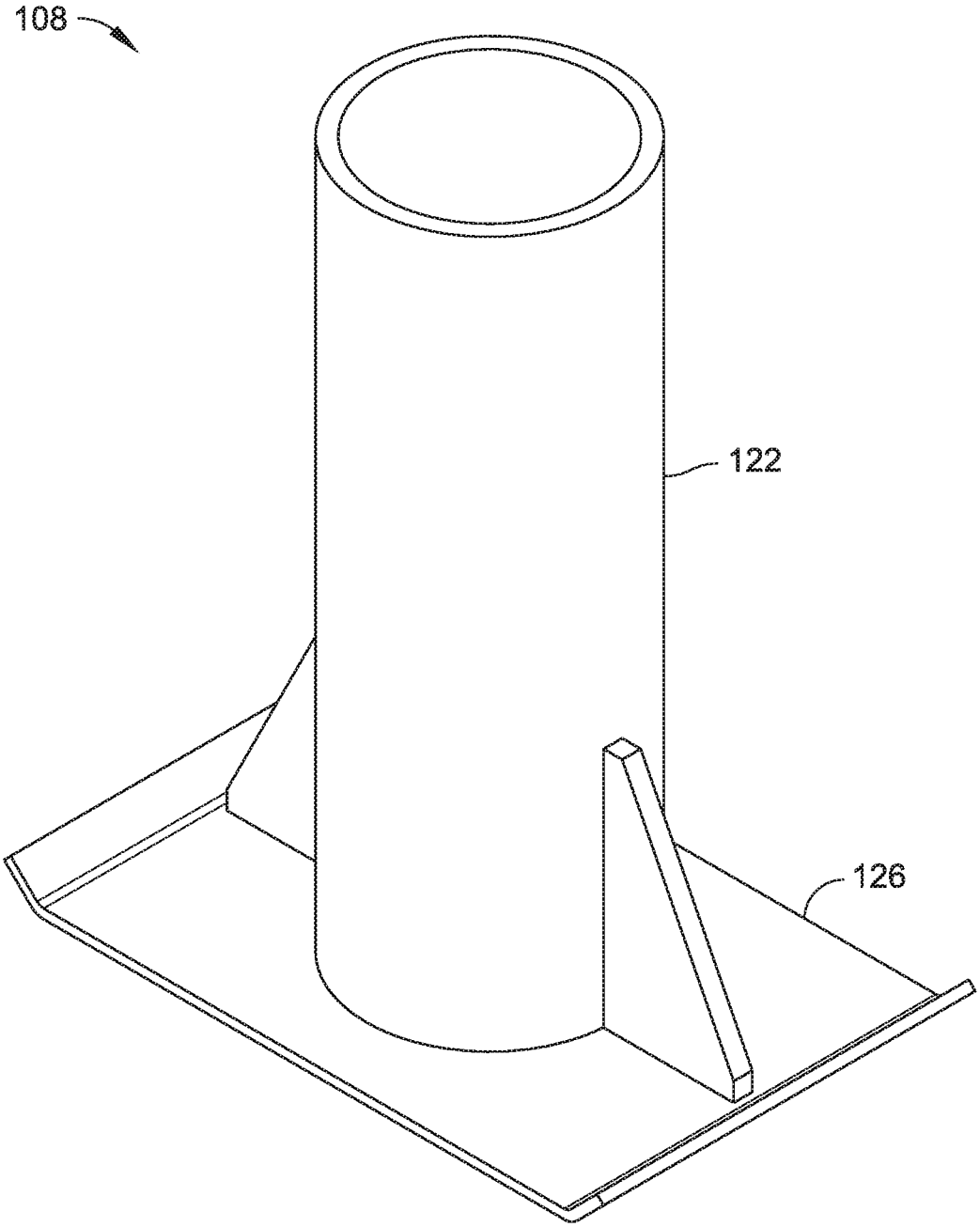
FIG. 5 is an isometric view of a ski assembly for the barrier system, in accordance with an embodiment of this disclosure.

In some embodiments, the barrier segments 102 are supported above a support surface 110 (e.g., above the ground) by support structures 106. The support structures 106 may be fastened to (e.g., bolted into or otherwise coupled to) the support surface 110 with fasteners 116 as shown in FIG. 2. In some embodiments, the support structures 106 are elastically-deformable supports (e.g., as shown in FIG. 3 and described in further detail below). Sliding posts 108 (e.g., ski-like structures as shown in FIGS. 4 and 5) can also be disposed between the barrier segments 102 and the support surface 110, where the sliding posts 108 can slide laterally upon the support surface 110 and provide secondary support to prevent the barrier segments 102 from overturning. For example, this may occur when any of the elastically-deformable support structures 106 are deformed as a result of a high impact.

Figure 6:
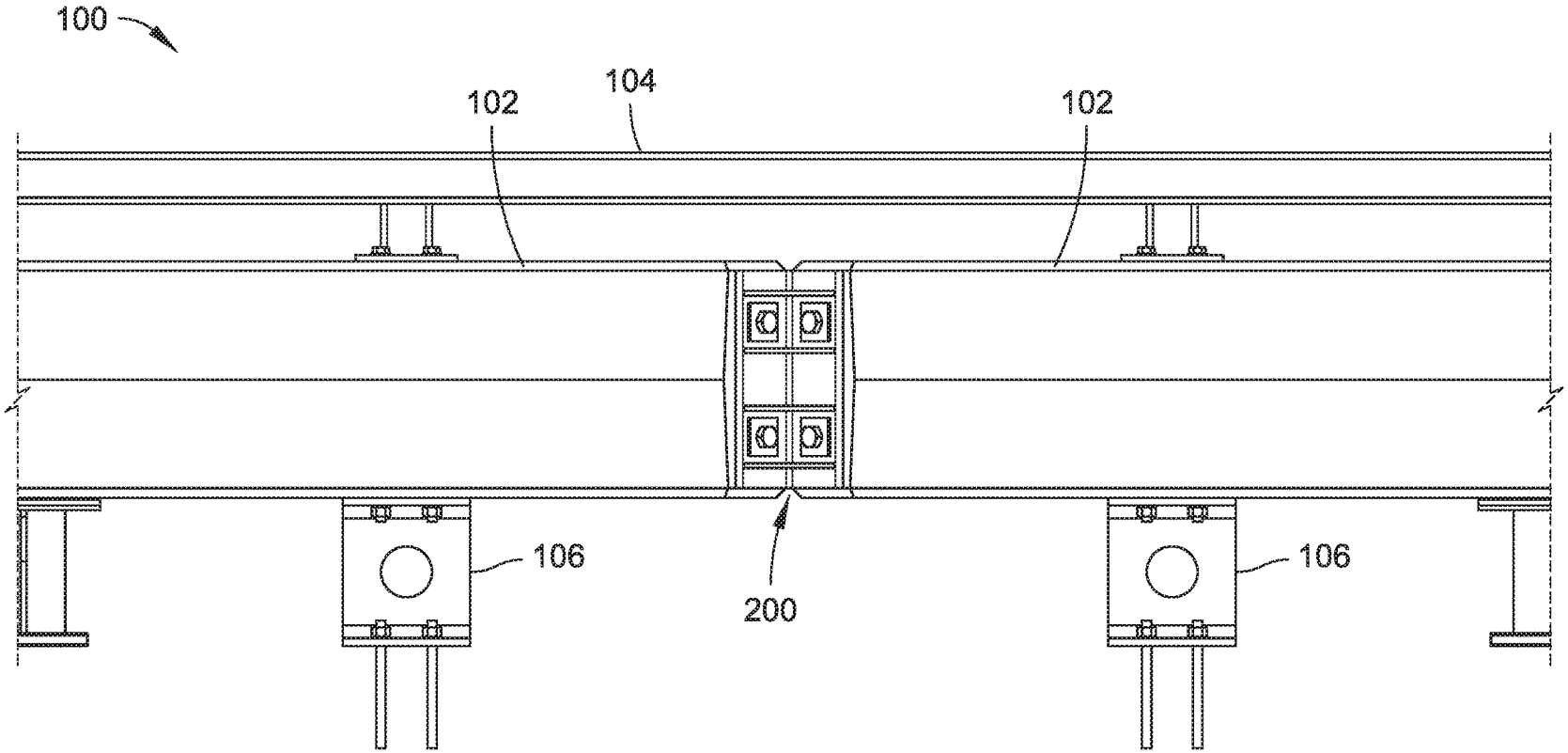
FIG. 6 is a side view showing the barrier system with a coupling assembly for connecting barrier segments of the barrier system, wherein the coupling assembly connects angled facets of the barrier segments with one another at a notch-shaped (e.g., V-shaped) interface, in accordance with an embodiment of this disclosure.
Figure 7:
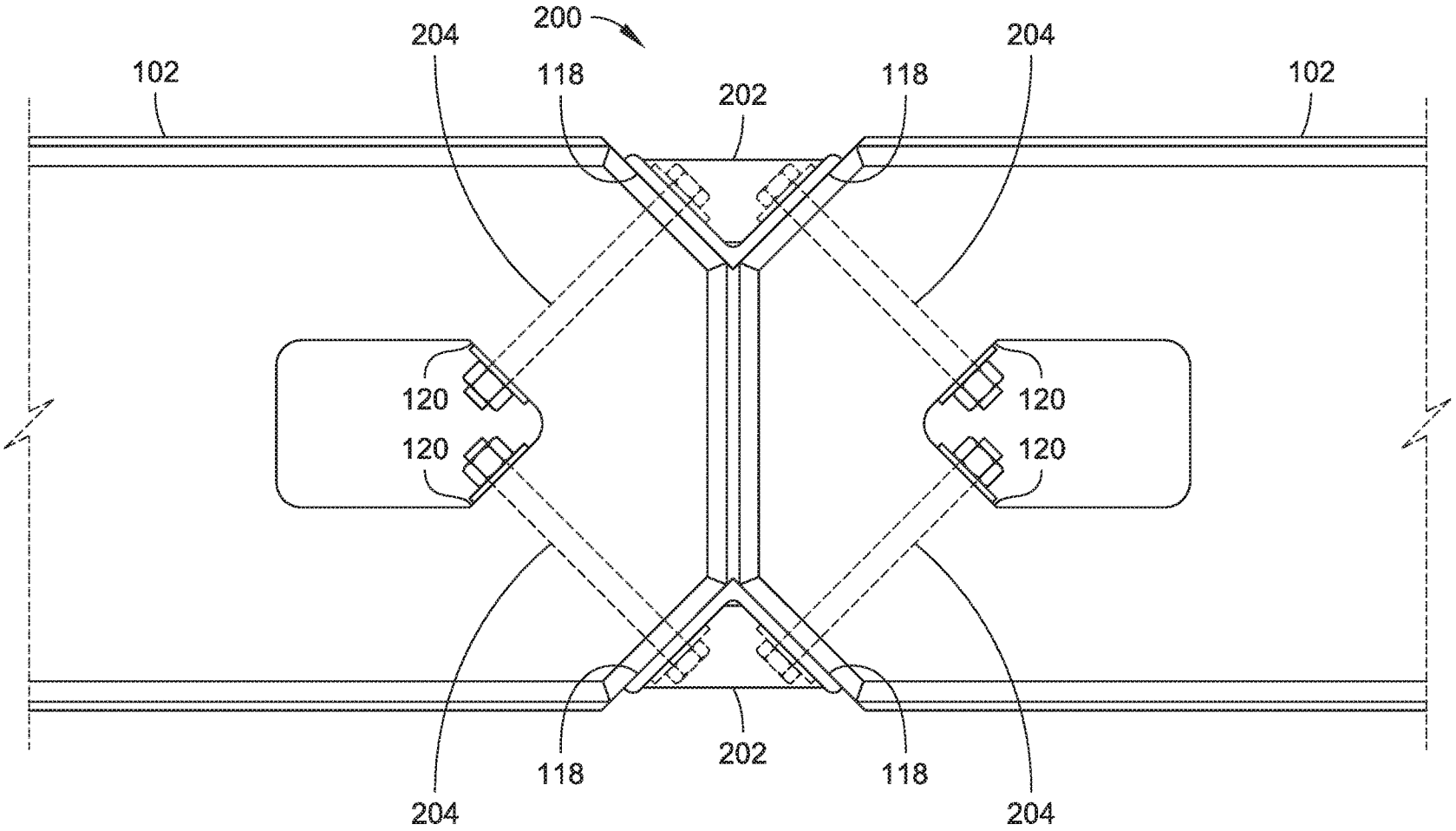
FIG. 7 is top plan view of the coupling assembly illustrated in FIG. 6.
Figure 8:
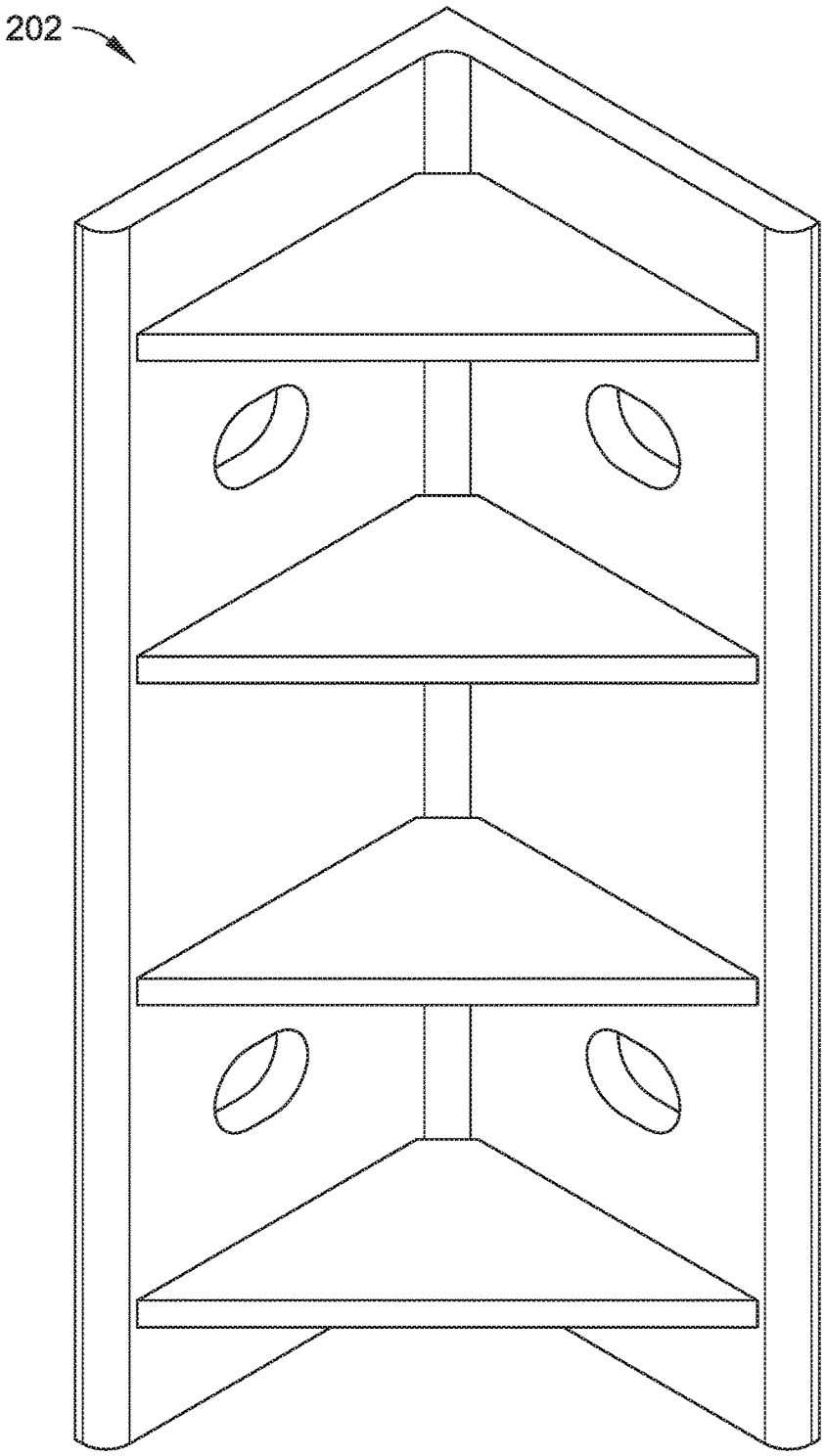
FIG. 8 is an isometric view of an angle joint for the coupling assembly illustrated in FIG. 6.
Figure 9:
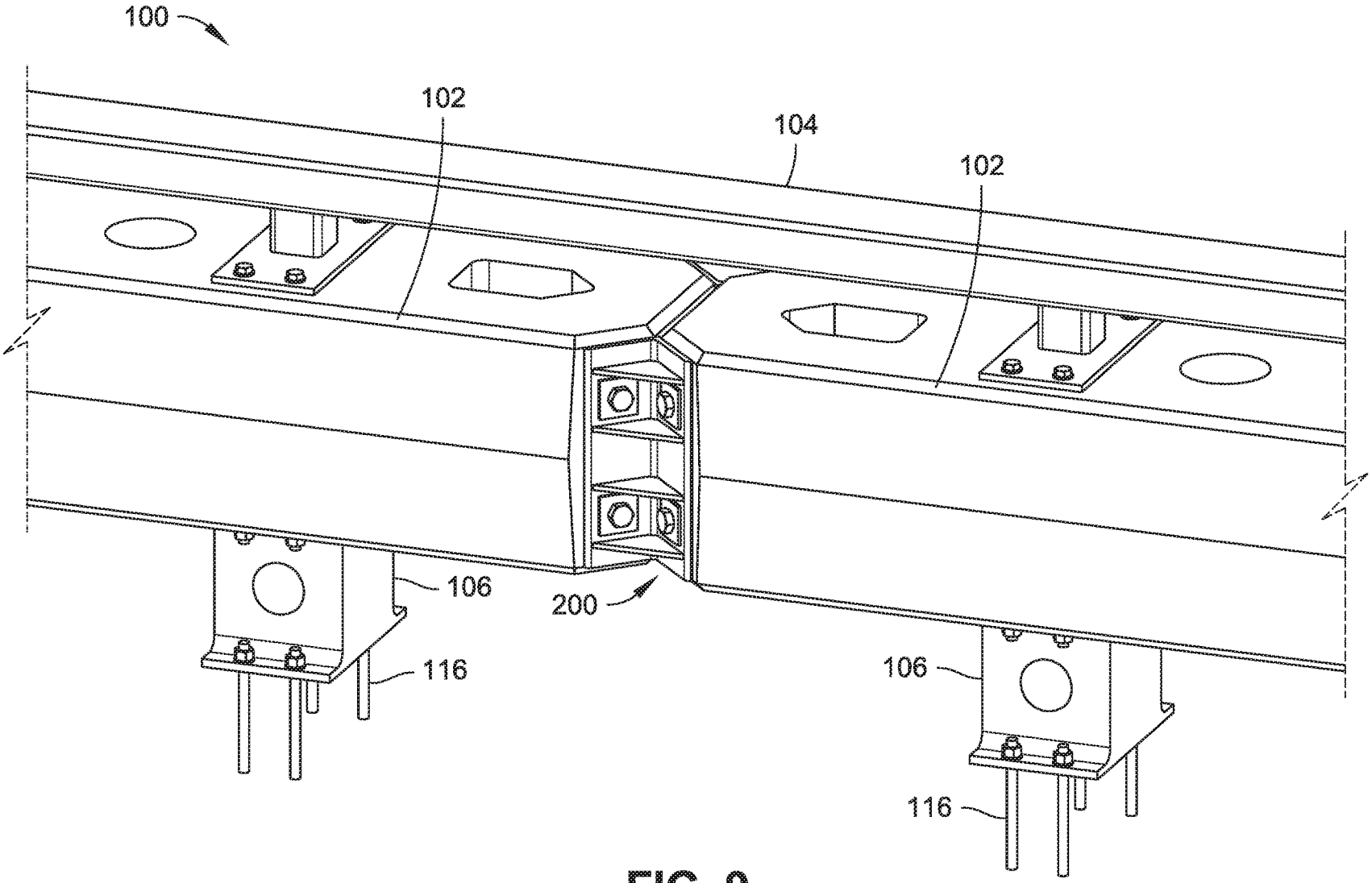
FIG. 9 is a partial perspective view showing the barrier system with the coupling assembly illustrated in FIG. 6.

FIG. 6 is a side view showing a coupling interface between two barrier segments 102. A perspective view is shown in FIG. 9. In some embodiments, the barrier system 100 includes two or more barrier segments 102 (e.g., concrete or high density material block, beam, panel, or the like) having a angled faces 118 at respective ends of the barrier segment 102. The coupling assembly 200 (e.g., sometimes referred to herein as the "ACJ") connects a first angled face 118 of a first barrier segment 102 to a second face 118 of a second barrier segment 102, and so on. Any number of barrier segments 102 can be connected in this fashion. In some embodiments, the ACJ 200 comprises a wedge-shaped or "V-shaped" connector 202 (e.g., as shown in FIG. 8) that adjoins prefabricated barrier segments 102 end-to-end. For example, a top plan view of the coupling interface is shown in FIG. 7. The ACJ 200 can be used on both the front and back sides of the barrier segments 102 (e.g., in the direction of loading).

The wedgeshaped connector 202 employs a geometry that fits the end geometry of the barrier segments 102. For example, the connector 202 simultaneously contacts the first angled face 118 of the first barrier segment 102 and the second angled face 118 of the second barrier segment 102. In some embodiments, the ACJ 200 uses slots with a wedge-shape connector 202 that allows it to slide inward toward the barrier segments 102 when there is a large gap, and outward away from the barrier segments 102 when there is a small gap. Fasteners 204 can be installed perpendicular to and extending through the wedged connector 202 and angled face 118 on the ends of the barrier segments 102. The barrier segments 102 can also have internal angled faces 120 for receiving the fasteners 204 that secure the connector 202 to outer angled faces 118. In some embodiments, a cover can be used to provide an aesthetic and/or closed joint (e.g., to prevent other objects, such as vehicles, from contacting and/or snagging within the joint and/or on the upstream end of the second longitudinally extending beam).

In some embodiments, the ACJ 200 can be used with a barrier system 100 in which rectangular-shaped, precast concrete beams 102 are connected to one another end-to-end. However, this configuration is provided by way of example only and is not meant to limit the present disclosure. In other embodiments, the ACJ 200 can be used to furnish continuity across joints in other various applications, including, but not necessarily limited to the fabrication of other structural elements, e.g., with materials such as concrete, steel, timber, plastic, aluminum, and so forth. In some embodiments, an ACJ can be used with other precast barrier systems, and/or in other applications, such as in buildings and bridges.

Figure 10:
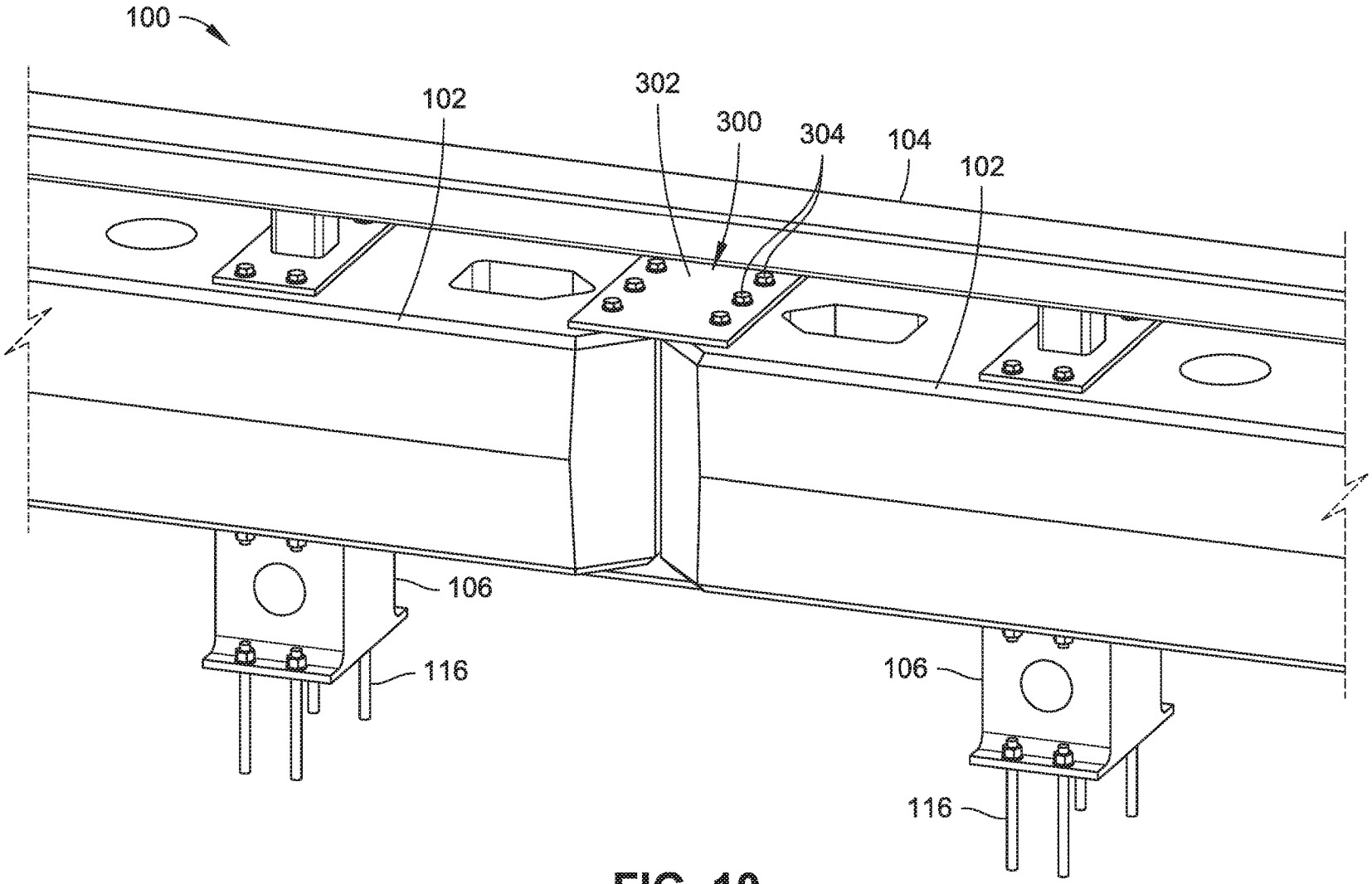
FIG. 10 is a partial perspective view showing the barrier system with a coupling assembly for connecting barrier segments of the barrier system, wherein the coupling assembly comprises a splice plate system, in accordance with an embodiment of this disclosure.
Figure 11:
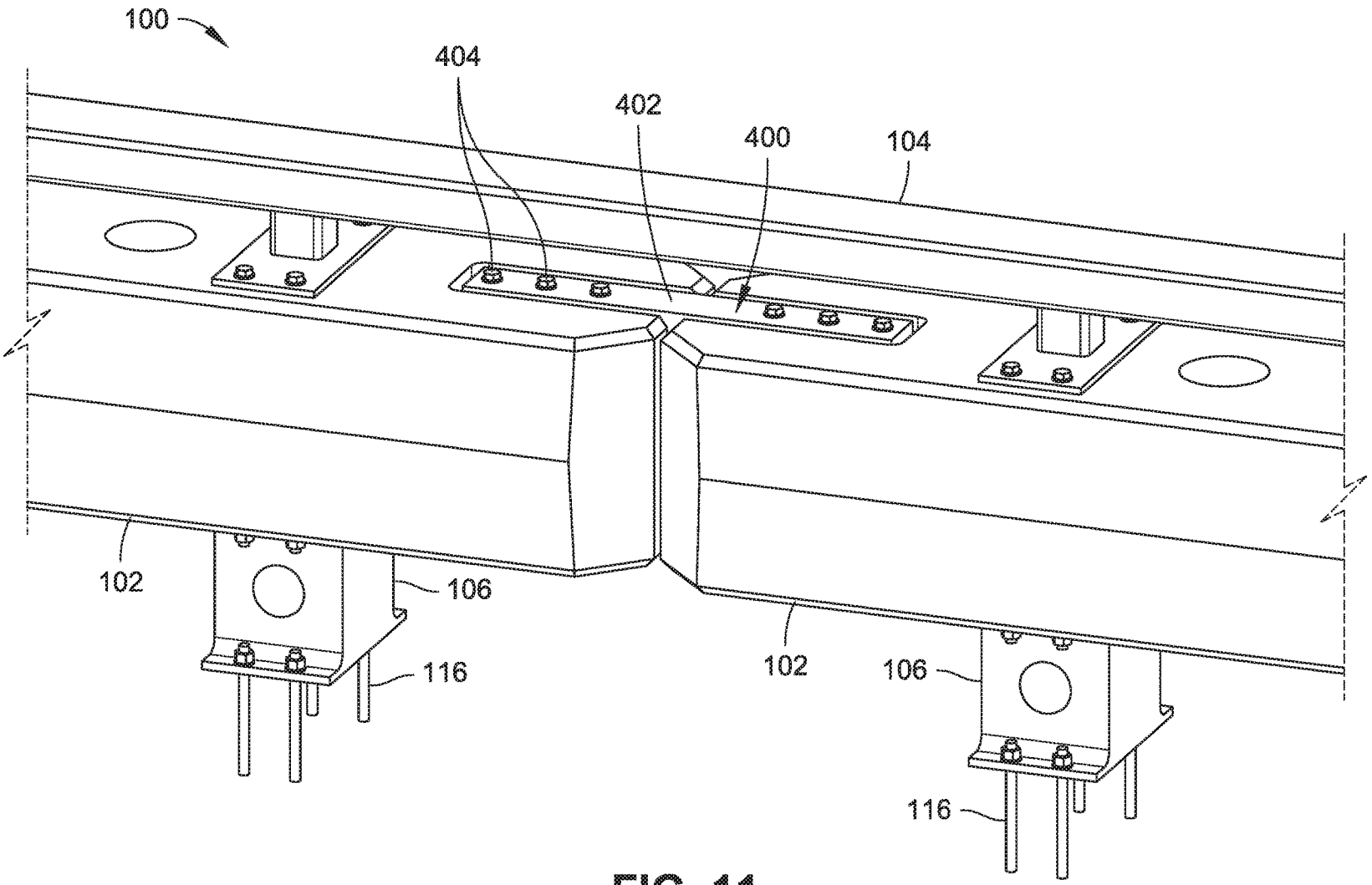
FIG. 11 is a partial perspective view showing the barrier system with a coupling assembly for connecting barrier segments of the barrier system, wherein the coupling assembly comprises a splice tube system, where the barrier segments are notched, and rectangular support tubes are inserted into the notches and fastened thereto, in accordance with an embodiment of this disclosure.
Figure 12:
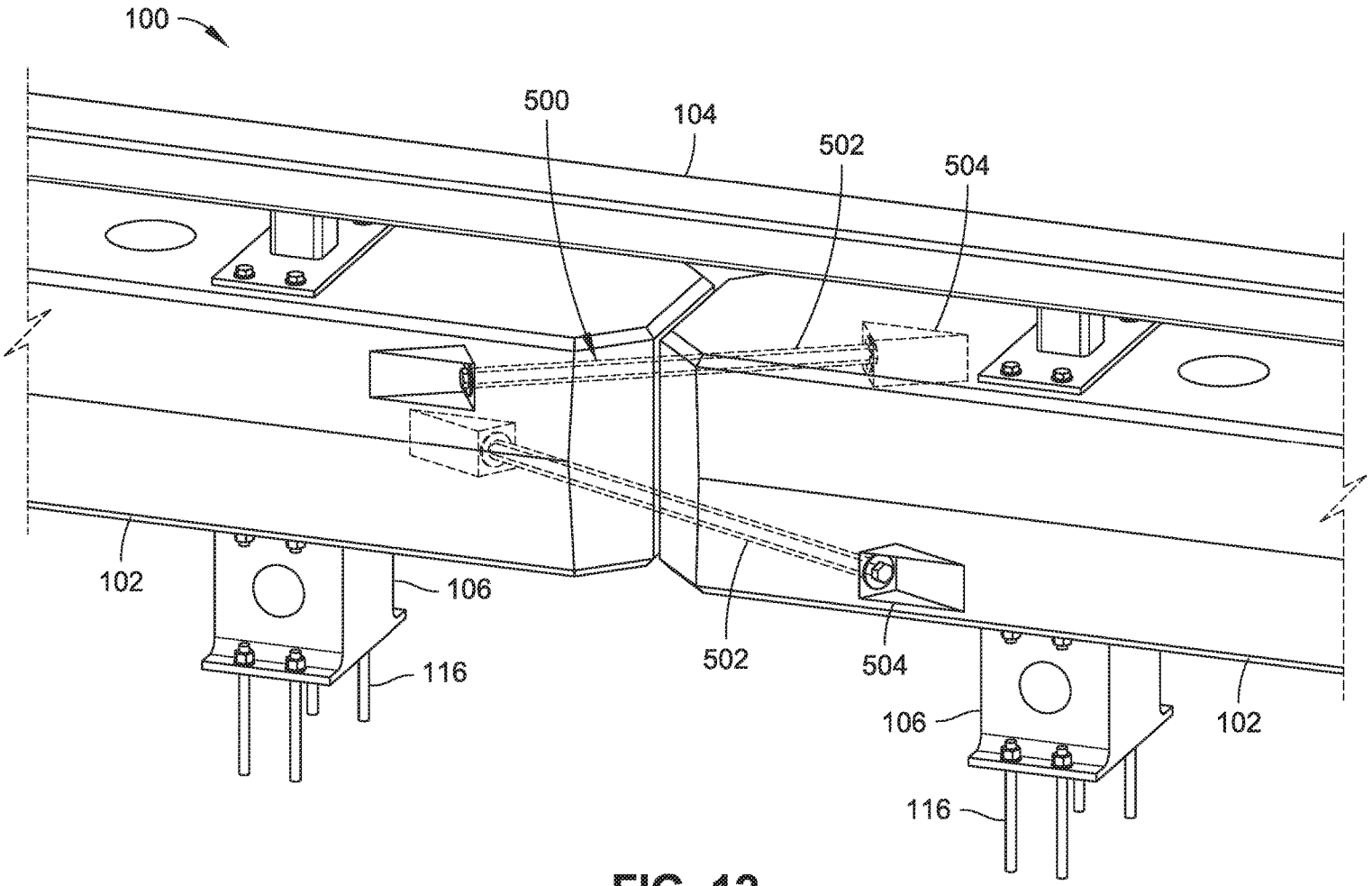
FIG. 12 is a partial perspective view showing the barrier system with a coupling assembly for connecting barrier segments of the barrier system, wherein the coupling assembly comprises an X-connection system for the barrier system, in accordance with an embodiment of this disclosure.

FIGS. 10 through 12 show coupling assemblies other than the ACJ 200 that can be used for barrier systems, such as barrier system 100. For example, FIG. 10 shows the barrier system 100 with a coupling assembly 300 for connecting barrier segments 102 together end-to-end, where the coupling assembly 300 comprises a splice plate 302 secured by fasteners 304 to the ends of barrier segments 102. Another example is shown in FIG. 11, a coupling assembly 400 comprises a splice tube system, where the barrier segments are notched, and rectangular support tubes 402 are inserted into the notches and secured with fasteners 404. Yet another example, is shown in FIG. 12, where a coupling assembly 500 comprises an X-connection system having fasteners 502 extending through drill holes 504 made diagonally through the barrier segments 102, such that at least a first fasteners 502 is transverse to a second fastener 502 when both are inserted fully through the barrier segments 102, each fastener 502 extending through at least a portion of the first barrier segment 102 and also through at least a portion of the second barrier segment 102. In any of the aforementioned embodiments, the coupling assembly connects an end of a first barrier segment 102 to an end of a second barrier segment 102, and the coupling assembly in contact with both internal and external portions of the first and second barrier segments 102, effectively bridging the barrier segments 102 together.

As described above, with reference to FIGS. 1 through 5, energy-absorbing, restorable traffic barrier systems 100 can employ sliding support posts 108 (e.g., ski-slike support posts) to the barrier segements 102. The sliding posts 108 can allow the barrier to translate during impact events with limited barrier rotations and then restore to its original position. As shown in FIGS. 4 and 5, the sliding post 108 can include a support member 122 (e.g., having a circular cross-section as shown, or rectangular or other geometry in some cases) with a skid plate-like base structure 126 that slides on the support surface 110 when the sliding post 108 is tilted from an impact force on the barrier segment 102. The sliding posts 108 can be used with a barrier system 100 in which rectangular-shaped, precast concrete beams 102 are supported by elastically-deformable supports 106 (e.g., rubber posts, blocks, etc.) and also partially supported by the sliding posts 108 (e.g., steel skis or the like). Due to the large weight of the barrier segments 102 (e.g., precast concrete beams) used in the barrier system 100, the sliding posts 108 can be used to support part of the weight of the barrier segment 102 and allow it to slide laterally, which allows the elastically-deformable supports 106 to deflect and absorb energy during vehicle impact events and then restore. Not only can the sliding posts 108 help support the rail weight and slide with the barriers, the wide base 126 of the sliding post 108 may also prevent the system 100 from excessively rotating backward when impacted. For attachment to an energy-absorbing traffic barrier segment 102, the support member 122 of the sliding post 108 can be inserted into prefabricated holes placed vertically through the barrier segement 102 and/or attached to the bottom of the barrier segment 102.

In some embodiments, the sliding post 108 can also include a support platform 124 that helps support the barrier segment 102 when the barrier segment 102 is placed upon the sliding post 108. For example, shelves 124 (e.g., as shown in FIG. 4) can be attached to the support members 122 at approximately the same height of the elastically-deformable supports 106, which can allow barrier segments 102 to rest on top of the shelves 124 at a desired height. Rubber or neoprene bearing pads can also be inserted between the shelf 124 and the bottom of the barrier segment 102 to allow for adjustability in system height due to construction tolerances and/or changes in site conditions, such as vertical curvature of the roadway. It should be noted that sliding posts 108 described herein may also have applicability in other traffic safety barriers that may benefit from a post that can support the weight of rail elements, translate laterally, and restore during and/or after vehicle impact events, and prevent the barrier system from rotating excessively.

In some embodiments, the sliding posts 108 can support most of the weight of barrier segments 102 but can still allow the barrier system 100 to deflect and restore freely. In some embodiments, the support member 122 of the sliding post 108 can be round steel tubing that fits snugly into the lower portion of vertical holes in the barrier segments 102. However, round tubing is provided by way of example and is not meant to limit the present disclosure. In other embodiments, differently shaped tubing structure and/or holes can be used, including, but not necessarily limited to: rectangular-shaped tubing and/or holes, squareshaped tubing and/or holes, octagonally-shaped tubing and/or holes, and so forth. In some embodiments, sliding posts 108 may not necessarily support the weight of the barrier segments 102 (e.g., primarly serving to provide lateral stability). In this example, one or two, or more, sliding posts 108 may be placed under one barrier segment 102, providing a stable system. In some embodiments, elastically-deformable supports 106 and sliding posts 108 can both be used to support most of the weight of the barrier segments 102 (e.g., as shown in FIG. 1). Since site terrain may not be completely level, shims (e.g., rubber and/or steel shims) can be installed between the support member 122 of the sliding post 108 and the bottom of the barrier segment 102.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A barrier system, comprising:

a first precast barrier segment having a first angled face at an end of the first precast barrier segment;

a second precast barrier segment having a second angled face at an end of the second precast barrier segment, the end of the second precast barrier segment connected to the end of the first precast barrier segment; and a coupling assembly connecting the first angled face of the first precast barrier segment to the second angled face of the second precast barrier segment, wherein the coupling assembly comprises angled faces that simultaneously contact both the first angled face of the first precast barrier segment and the second angled face of the second precast barrier segment.

2. The barrier system of claim 1, wherein the first and second precast barrier segments are precast concrete barrier segments.

3. The barrier system of claim 1, wherein the first precast barrier segment has a third angled face at the end of the first precast barrier segment, on a side opposite the first angled face, wherein the second precast barrier segment has a fourth angled face at the end of the second precast barrier segment, on a side opposite the second angled face, and wherein a second coupling assembly connects the third angled face of the first precast barrier segment to the fourth angled face of the second precast barrier segment.

4. The barrier system of claim 1, wherein the coupling assembly comprises a V-shaped connector that simultaneously contacts the first angled face of the first precast barrier segment and the second angled face of the second precast barrier segment.

5. The barrier system of claim 4, further comprising fasteners that secure the V-shaped connector to the first angled face of the first precast barrier segment and to the second angled face of the second precast barrier segment.

6. The barrier system of claim 5, wherein the first precast barrier segment has a first internal angled face for receiving a first fastener that secures the V-shaped connector to the first angled face, and wherein the second precast barrier segment has a second internal angled face for receiving a second fastener that secures the V-shaped connector to the second angled face.

7. A barrier system, comprising:

a first precast barrier segment having a first angled face at an end of the first precast barrier segment;

a second precast barrier segment having a second angled face at an end of the second precast barrier segment, the end of the second precast barrier segment connected to the end of the first precast barrier segment;

a coupling assembly connecting the first angled face of the first precast barrier segment to the second angled face of the second precast barrier segment; and an elastically-deformable support structure for supporting the first precast barrier segment on a support surface.

8. The barrier system of claim 7, further comprising:

a first sliding post disposed between the first precast barrier segment and the support surface, the sliding post configured to slide laterally upon the support surface and at least partially support the first precast barrier segment to prevent the first precast barrier segment from overturning when the elastically-deformable support structure is deformed.

9. The barrier system of claim 7, wherein the first and second precast barrier segments are precast concrete barrier segments.

10. The barrier system of claim 7, wherein the first precast barrier segment has a third angled face at the end of the first precast barrier segment, on a side opposite the first angled face, wherein the second precast barrier segment has a fourth angled face at the end of the second precast barrier segment, on a side opposite the second angled face, and wherein a second coupling assembly connects the third angled face of the first precast barrier segment to the fourth angled face of the second precast barrier segment.

11. The barrier system of claim 7, wherein the coupling assembly comprises a V-shaped connector that simultaneously contacts the first angled face of the first precast barrier segment and the second angled face of the second precast barrier segment.

12. The barrier system of claim 11, further comprising fasteners that secure the V-shaped connector to the first angled face of the first precast barrier segment and to the second angled face of the second precast barrier segment.

13. The barrier system of claim 12, wherein the first precast barrier segment has a first internal angled face for receiving a first fastener that secures the V-shaped connector to the first angled face, and wherein the second precast barrier segment has a second internal angled face for receiving a second fastener that secures the V-shaped connector to the second angled face.

14. A structural assembly, comprising:

a first prefabricated structural element having a first angled face at an end of the first prefabricated structural element;

a second prefabricated structural element having a second angled face at an end of the second prefabricated structural element, the end of the second precast barrier segment connected to the end of the first prefabricated structural element; and a coupling assembly connecting the first angled face of the first prefabricated structural element to the second angled face of the second prefabricated structural element, the coupling assembly providing shear and moment continuity across the first and second prefabricated structural elements, wherein the coupling assembly comprises angled faces that simultaneously contact both the first angled face of the first precast barrier segment and the second angled face of the second precast barrier segment.

15. The structural assembly of claim 14, wherein the first prefabricated structural element has a third angled face at the end of the first prefabricated structural element, on a side opposite the first angled face, wherein the second prefabricated structural element has a fourth angled face at the end of the second prefabricated structural element, on a side opposite the second angled face, and wherein a second coupling assembly connects the third angled face of the first prefabricated structural element to the fourth angled face of the prefabricated structural element.

16. The structural assembly of claim 14, wherein the first and second prefabricated structural elements comprise steel, concrete, fiber-reinforced plastic (FRP), or wood.

17. The structural assembly of claim 14, wherein the first and second prefabricated structural elements comprise barrier segments.

18. The structural assembly of claim 14, wherein the coupling assembly comprises a V-shaped connector that simultaneously contacts the first angled face of the first prefabricated structural element and the second angled face of the second prefabricated structural element.

19. The structural assembly of claim 18, further comprising fasteners that secure the V-shaped connector to the first angled face of the first prefabricated structural element and to the second angled face of the second prefabricated structural element.

20. The structural assembly of claim 19, wherein the first prefabricated structural element has a first internal angled face for receiving a first fastener that secures the V-shaped connector to the first angled face, and wherein the second prefabricated structural element has a second internal angled face for receiving a second fastener that secures the V-shaped connector to the second angled face.

* * * * *